United States Patent [19]

Benedyk

[11] 4,181,762

[45] Jan. 1, 1980

[54] FIBERS, YARNS AND FABRICS OF LOW MODULUS POLYMER

[75] Inventor: Joseph C. Benedyk, Highland Park, Ill.

[73] Assignee: Brunswick Corporation, Skokie, Ill.

[21] Appl. No.: 17,465

[22] Filed: Mar. 5, 1979

Related U.S. Application Data

[63] Continuation-in-part of Ser. No. 871,091, Jan. 19, 1978, abandoned, which is a continuation of Ser. No. 665,632, Mar. 10, 1976, abandoned.

[51] Int. Cl.[2] ..... D02G 3/00; D04H 11/00

[52] U.S. Cl. ..... 428/97; 57/243; 57/246; 428/87; 428/92; 428/93; 428/95; 428/96; 428/364; 428/372; 428/921

[58] Field of Search ..... 428/85, 92, 95, 97, 428/87, 93, 96, 921, 364, 394, 401, 372; 57/243, 246; 526/331

[56] References Cited

U.S. PATENT DOCUMENTS

| | | | |
|---|---|---|---|
| 3,012,303 | 12/1961 | Whitaker et al. | 28/72.16 |
| 3,081,485 | 3/1963 | Steigerwald | 264/210 F |
| 3,086,275 | 4/1963 | Pritchard | 428/394 X |
| 3,293,105 | 12/1966 | Koller | 428/97 X |
| 3,293,339 | 12/1966 | Gates | 264/210 F |
| 3,394,043 | 7/1968 | Parlin et al. | 428/97 |
| 3,422,615 | 1/1969 | Norman | 428/92 |
| 3,579,764 | 5/1971 | Kieffer | 28/72.16 |
| 3,591,674 | 6/1971 | Engel | 264/210 R X |
| 3,605,666 | 9/1971 | Kimmel et al. | 28/109 |
| 3,663,345 | 5/1972 | Jaisinghani | 428/97 |
| 3,686,848 | 8/1972 | Miller et al. | 264/168 X |
| 3,689,848 | 8/1972 | Miller et al. | 330/259 |
| 3,801,551 | 4/1974 | Bohme | 526/331 X |
| 3,940,525 | 2/1976 | Ballard | 428/97 X |
| 3,976,631 | 8/1976 | Van de Molen | 526/331 |
| 3,976,820 | 8/1976 | Giovanelli | 428/85 |
| 4,118,530 | 10/1978 | Benedyk et al. | 428/97 |

FOREIGN PATENT DOCUMENTS 1278689 9/1968 Fed. Rep. of Germany .

*Primary Examiner*—Lorraine T. Kendell

*Attorney, Agent, or Firm*—William G. Lawler; John G. Heimovics; James S. Waldron

[57] ABSTRACT

Fibers, yarns and fabrics are produced from polymers, such as the copolymers of ethylene and vinyl acetate, having an elastic modulus of from 5,000 to 60,000 psi. The fibers are also characterized by an area moment of inertia of from $400\times10^{-14}$ to $7{,}000\times10^{-14}$ in$^4$ and a stiffness parameter of from $1\times10^{-5}$ to $1\times10^{-8}$ lb-in$^2$. Multiple fibers are spun into yarn, preferably cross-linked either chemically or by irradiation and are formed into pile fabrics for carpeting and similar uses. The pile fabric preferably has a minimum of 4,000 fibers per in$^2$ of backing and a minimum pile height of $\frac{1}{8}$ inch.

63 Claims, 8 Drawing Figures

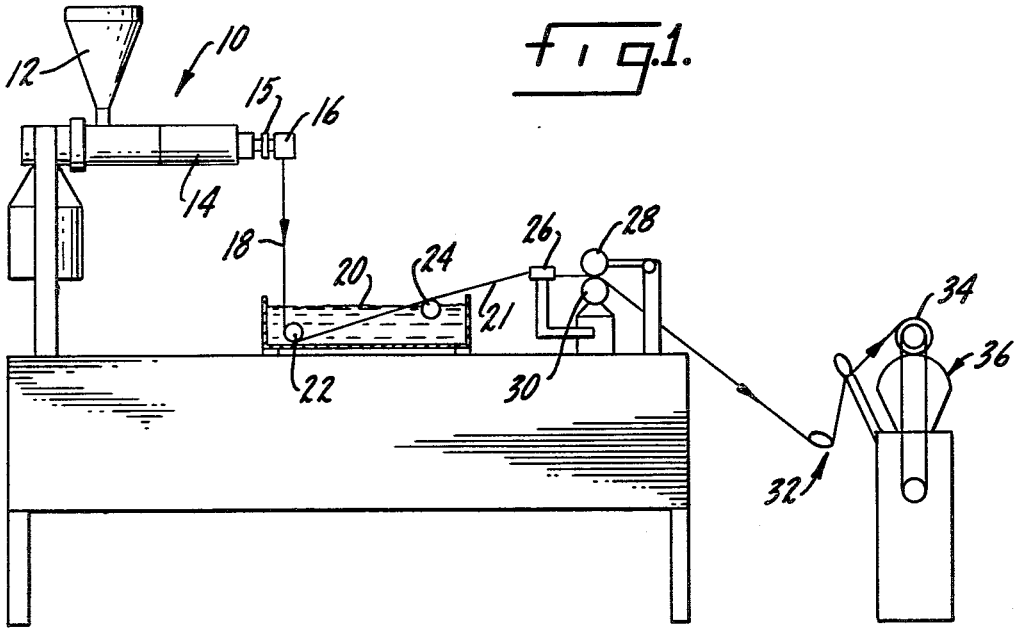
fig.1.
fig.1a.
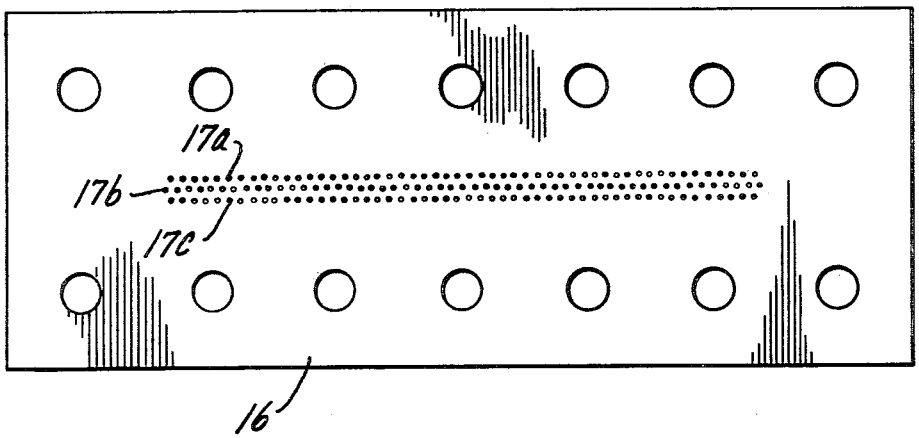
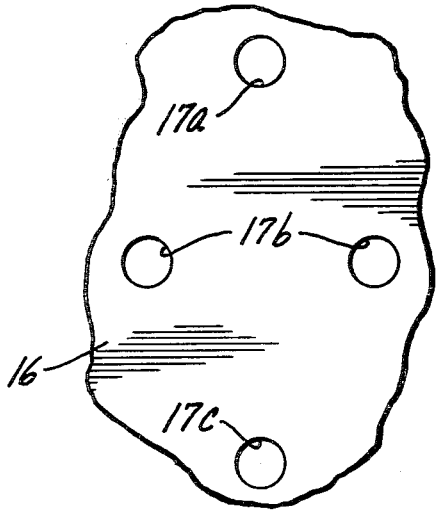
fig.1b.

fig.2.
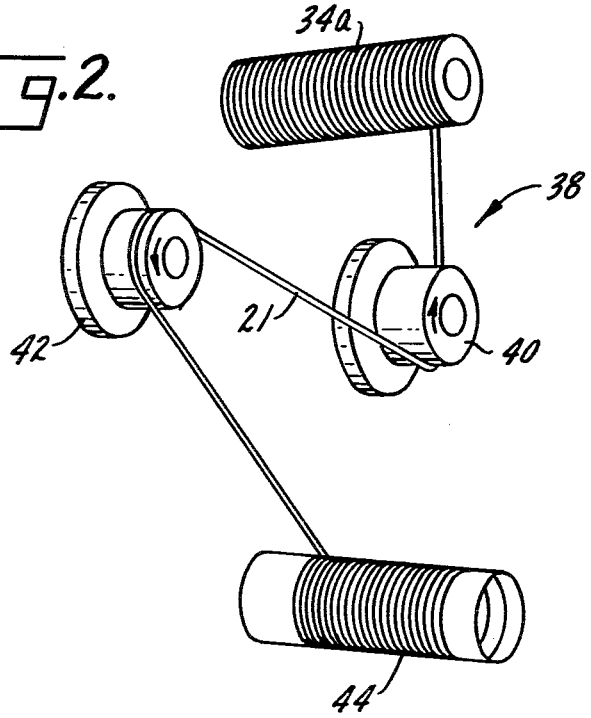
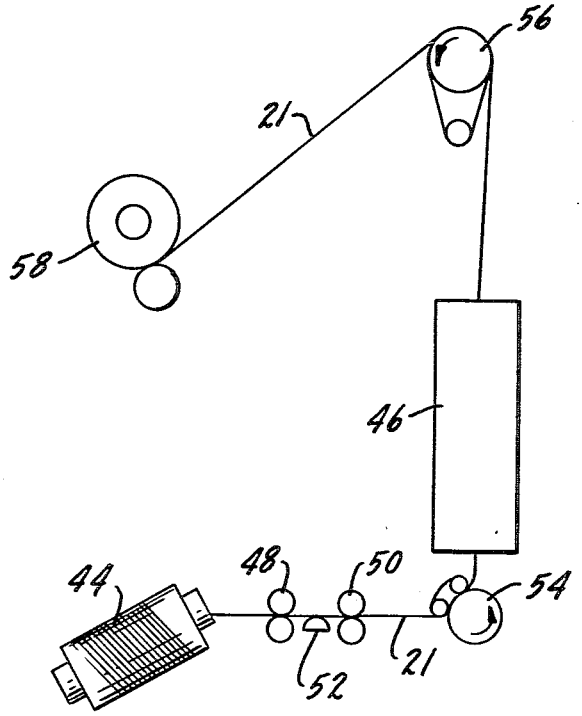
fig.3.

FIBERS, YARNS AND FABRICS OF LOW MODULUS POLYMER

CROSS-REFERENCES TO RELATED APPLICATIONS

This application is a continuation-in-part of application Ser. No. 871,091 filed Jan. 19, 1978, and now abandoned; which in turn is a continuation of application Ser. No. 665,632 filed Mar. 10, 1976, and now abandoned.

BACKGROUND OF THE INVENTION

This invention relates generally to the production of monofilament fibers from low modulus polymeric materials and to yarns and fabrics made therefrom.

More specifically, this invention relates to fibers having a unique combination of physical properties, including elastic modulus, area moment of inertia and stiffness parameter and to their use in the production of yarns and fabrics offering advantages over those of conventional manufacture.

Historically, man-made fibers have been engineered so that the physical properties of such fibers are about the same as textile fibers found in nature, for example, cotton or wool. Natural textile fibers are generally thin, having a diameter less than about 2 mils and having a high elastic modulus, for example, a modulus greater than about 200,000 psi. Thus, synthetic fibers are thin and have a high modulus. For example, a typical commercially-available, polyethylene monofilament having a tensile strength of about 28,500 psi displays an elastic modulus of about 340,000 psi. Such thin, high modulus fibers have a stiffness parameter generally ranging between about $1\times10^{-5}$ and about $1\times10^{-8}$ lb-in$^2$. In general, any fiber having a stiffness parameter within this range will feel soft and pliant. Because conventional fibers have a relatively high elastic modulus, usually well above 200,000 psi, they must have a relatively low moment of inertia, otherwise they would feel too stiff.

Elastic modulus, designated as $E_f$, is determined by measuring the initial slope of the stress-strain curve derived according to ASTM standard method No. D2256-69. Strain measurements are corrected for gauge length variations by the method described in an article entitled "A Method for Determining Tensile Strains and Elastic Modulus of Metallic Filaments", ASM Transactions Quarterly, Vol. 60, No. 4, December 1967, pp. 726–27.

The moment of inertia, designated $I_f$, of a fiber is a function of its cross-sectional area. Under normal loading conditions, fibers bend about a neutral axis where the moment of inertia will be a minimum value. The moment of inertia about this neutral axis is calculated using the following equation:

$$I_f=\int Y^2 dA$$

where dA is any incremental area of the fiber's cross-section and y is the distance any such incremental area is from the neutral axis.

For fibers with a uniform circular cross-sectional configuration, the moment of inertia ($I_f$) may be calculated by the following formula:

$$I_f=(\pi d^4)/64$$

where d is the fiber diameter. Specific equations for calculating the moments of inertia of fibers having a cross-sectional configuration other than circular are given in a paper presented at the 47th annual meeting of the ASTM, Vol. 44, (1944).

The stiffness parameter of a fiber, designated $K_f$, is a general indicator of the feel, or hand, of a fabric made from that fiber. When considering the hand of any fiber, one must take into account the specific textile construction in which the hand is being judged. In a fabric of pile construction, for example, the fiber acts under loads like an upright column. In other words, when one touches the fiber, a downward force is exerted on the upright fibers. At a critical load, the fibers will buckle or bend. The more rigid or stiff the fibers, the greater the load required to bend the fibers. Good hand is associated with fibers that are pliant.

Although other factors affect the hand of pile fabrics, the chief factor is the fiber stiffness which is a function of the material properties of the fiber, the geometry of the fiber and the manner in which load is applied to the fiber. In general terms, one may compare the hand of different fabrics by comparing the stiffness parameter of the fibers, where each fiber has a uniform cross-section and is composed of the same material throughout. This stiffness parameter is the product of the elastic modulus of the fiber and the area moment of inertia of the fiber:

$$K_f=E_f\times I_f$$

DISCUSSION OF THE PRIOR ART

A number of thermoplastic polymeric materials having an elastic modulus in the range of 5,000 to 60,000 psi are known and are commercially available. Examples of such known and commercially available polymers include ethylene-vinyl acetate copolymers, plasticized polyvinyl chloride, low density polyethylene, ethylene-ethyl acrylate copolymer, ethylene-butylene copolymer, polybutylene and various copolymers thereof, certain ethylene-propylene copolymers, chlorinated polypropylene, chlorinated polybutylene and various compatible mixtures of these thermoplastics. However, the prior art has consistently viewed these polymers as unsuitable for use in fibers precisely because of their low elastic modulus and also because of their uniformly low tensile strength.

It is also known to produce elastomeric fibers from various rubbery polymers as, for example, spandex which comprises a synthetic polymer of a segmented polyurethane. Elastomeric fibers comprising an ethylene-vinyl acetate copolymer are also known as is disclosed in German Patent No. 1,278,689. Copolymers used have a vinyl acetate content of 40 to 45% and fibers are spun from a solution of the polymer in a solvent such as methylene chloride. Elastic modulus of the fibers produced by the process of the German patent is about 0.08–0.09 Kp/mm$^2$ which, in English units, is about 120–130 lb/in$^2$.

Ethylene-vinyl acetate polymeric compositions have also been proposed for use as a hot melt adhesive backsizing for tufted carpets as is disclosed in U.S. Pat. No. 3,940,525.

Techniques to form fiber into yarn and to manufacture pile fabrics from yarn are, of course, well known. Exemplary patents illustrating these techniques include U.S. Pat. Nos. 3,605,666 and 3,686,848.

SUMMARY OF THE INVENTION

I have found that fibers suitable for use in making pile fabrics such as carpeting may be manufactured of polymeric materials heretofore considered completely unsuited for such use provided that certain criteria are met. The polymeric material must have an elastic modulus in the range of about 5,000 to about 60,000 psi and will typically display an ultimate tensile strength in the range of about 5,000 to 50,000 and preferably in the range of 5,000 to 20,000 psi. The fiber itself, which may be produced in monofilament form by extrusion through an orifice, must display an area moment of inertia from $400\times10^{-14}$ to $7{,}000\times10^{-14}$ $in^4$ and a stiffness parameter of from $1\times10^{-5}$ to $1\times10^{-8}$ lb-in$^2$. Fibers are formed into yarn in conventional fashion and the yarn is used to produce pile fabrics such as carpeting. The resulting fabric displays esthetic qualities comparable to those made of conventional carpet fibers, such as nylon, at a small fraction of the material cost. In addition to substantial economic advantages, fabrics produced from my fibers display greater matting resistance, greater cleanability, better inherent antistatic properties, a lesser tendency to produce carpet burns and a greater resistance to damage from hot objects such as cigarettes than do fabrics of conventional fibers.

Hence, it is an object of my invention to produce fibers having properties uniquely suited for use in pile carpets.

It is a further object of my invention to provide yarns of those fibers and to manufacture pile fabrics therefrom.

It is a further object of my invention to provide pile fabrics of low modulus fibers displaying esthetic qualities comparable to those of traditional fibers.

A specific object of my invention is to provide low-cost, high quality pile fabrics suitable for use as carpeting.

GENERAL DISCUSSION OF THE INVENTION

Nylon fiber is one of the most versatile and useful man-made fibers developed to date. In its monofilament form it is bulked by crimping or other bulking method and twisted together to form a nylon yarn which is particularly suited for carpets. These nylon yarns, when tufted through a suitable backing, form a pile fabric that has excellent wearability and a good hand, i.e., it is pleasant to the touch.

Since the cost of nylon has increased substantially over the past few years, lower cost substitutes having physical characteristics similar to that of nylon are being sought. Polypropylene yarns recently have been introduced which for some applications serve as a substitute for nylon carpet yarns. To date, carpets employing polypropylene face yarns have made modest penetration of the market, and polypropylene yarns now represent approximately 5 percent of the face yarns used in the manufacture of carpets.

The search for alternatives to nylon has focused almost exclusively on attempts to duplicate, or substantially duplicate, the properties of nylon, i.e. high elastic modulus, thermoplasticity, high tensile strength and relatively high melting point. I have found that by concentrating instead upon the properties desired in the manufactured fabric, physical parameters of a fiber can be set to achieve the desired properties using polymeric materials heretofore considered inappropriate or unacceptable for fiber use.

Specifically, I have found that the esthetic qualities of high-grade fabrics of traditional fibers such as nylon can be substantially duplicated or even improved upon by selecting a low modulus polymer and producing fibers therefrom having an increased diameter, or cross-sectional area, such that the resulting stiffness parameter is equivalent to that displayed by nylon.

The chief criterion for selecting a polymeric material for use in my invention is its elastic modulus. The best material discovered so far is an ethylene-vinyl acetate copolymer having a vinyl acetate content ranging from about 1 to about 10 percent by weight and a melt index of from about 0.5 to about 9. This material will provide the monofilament with the desired elastic modulus and is also relatively inexpensive. The following are examples of thermoplastic materials which will provide the monofilament with an elastic modulus within the range of from 5,000 to 60,000 psi: (a) plasticized polyvinyl chloride, (b) low density polyethylene, (c) thermoplastic rubber, (d) ethylene-ethyl acrylate copolymer, (e) ethylene-butylene copolymer, (f) polybutylene and copolymers thereof, (g) ethylene-propylene copolymers, (h) chlorinated polypropylene, (i) chlorinated polybutylene, or (j) mixtures of these thermoplastics.

Although the ethylene-vinyl acetate copolymer has the desired elastic modulus, one problem with this material is that it has a relatively low melting point. To obviate this problem and increase the heat resistance of the fiber, the molecules of the copolymer are cross-linked. Cross-linking may be achieved either during the manufacture of the fiber or subsequently. Conventional irradiation techniques may be employed or the molecules of the polymer may include moieties which react under selected conditions with other molecules to effect cross-linking. As will be discussed below in detail, it is desirable to use certain additives which greatly enhance cross-linking. Only partial cross-linking is desired so that the material retains the required elastic properties. Ordinarily, cross-linking increases the melting point of the material so that it is 200° F. or greater.

As has been stated previously, the polymeric materials suitable for use in my invention must have an elastic modulus in the range of about 5,000 to 60,000 psi. In order to obtain the desired properties of the finished pile fabric, it is required that the area moment of inertia of each individual fiber be increased sufficiently to provide a stiffness parameter within the range of that displayed by traditional fibers used in pile fabric manufacture.

The cross-sectional configuration of my fiber is not critical so long as the moment of inertia falls within the range of from about $400\times10^{-14}$ to about $7{,}000\times10^{-14}$ $in^4$. However, my fiber preferably has a generally circular cross-section. Consequently, to have the required moment of inertia ($I_f$), such a fiber would have a diameter in a range of from about 3 to about 6 mils, preferably from about 4 to about 5 mils. In terms of denier, my fiber usually has a denier of from 25 to 150 for fibers made of material having a specific gravity in the range of from about 0.90 to about 1.4.

Table I below compares the stiffness parameter, $K_f$, of conventional nylon and polypropylene fibers and ethylene-vinyl acetate fibers of my invention, all having circular cross-sections. Note the $K_f$ of all the fibers are within the range of from about $1\times10^{-5}$ to about $1\times10^{-8}$ lb-in$^2$, but the diameter, and consequently the moment of inertia, $I_f$, for my fiber is significantly larger than conventional fiber and the elastic modulus, $E_f$, of my fiber is substantially lower than that of conventional fibers.

TABLE I

| Fiber Type | d (in) | I ($in^4$) × $10^{-14}$ | E ($lb/in^2$) | $K_f$ ($lb\text{-}in^2$) × $10^{-8}$ |
|---|---|---|---|---|
| Nylon | 0.001 | 4.908 | 250,000 | 1.227 |
| | 0.001 | 4.908 | 500,000 | 2.454 |
| | 0.0015 | 24.850 | 250,000 | 6.212 |
| | 0.0015 | 24.850 | 500,000 | 12.425 |
| Poly-propylene | 0.002 | 78.539 | 250,000 | 19.635 |
| | 0.002 | 78.539 | 300,000 | 23.562 |
| | 0.003 | 397.607 | 250,000 | 99.402 |
| Ethylene-Vinyl Acetate | 0.003 | 397.607 | 50,000 | 19.880 |
| | 0.003 | 397.607 | 25,000 | 9,940 |
| | 0.003 | 397.607 | 5,000 | 1.988 |
| | 0.004 | 1256.637 | 50,000 | 62.831 |
| | 0.004 | 1256.637 | 25,000 | 31.416 |
| | 0.004 | 1256.637 | 5,000 | 6.283 |
| | 0.005 | 3067.961 | 50,000 | 153.398 |
| | 0.005 | 3067.961 | 25,000 | 76.699 |
| | 0.005 | 3067.961 | 5,000 | 15.339 |
| | 0.006 | 6361.725 | 50,000 | 318.086 |
| | 0.006 | 6361.725 | 25,000 | 159.043 |
| | 0.006 | 6361.725 | 5,000 | 31.8086 |

The fiber of my invention makes an excellent carpet yarn when multiple monofilaments are twisted together and bulked. Such yarn, tufted or otherwise formed into a pile fabric, forms a plush pile surface having a hand similar to that of pile surfaces formed from conventional nylon carpet yarns. It also has the other necessary physical properties to serve as a carpet yarn.

Physical properties of my fiber allow production of pile fabrics which have a good hand, resist matting and wear well. Yarn made from my fiber is tuftable or may otherwise be processed using conventional carpet marking techniques. Moreover, my fiber has good anti-static properties and fabrics made from my yarn are easy to clean because of the relatively large diameter of the individual fibers.

When one refers to the hand of a fabric, account must be taken of the specific textile construction and use of the fabric. Hand is a subjective thing based upon tactile impressions. Pile fabrics made from my fibers display a good hand as judged in comparision to fabrics made from traditional fibers such as nylon and polypropylene.

Resistance to Matting

Resistance to matting is a complex phenomemon due to a combination of several factors, including the ability of the fibers to recover on being deformed and their ability to avoid becoming entangled with each other. When a fiber is elongated beyond its yield point, it will plastically deform until it breaks. During matting the fiber is bent, elongating or straining portions of the fiber. For good matting resistance, one consideration is that the fiber should not yield substantially when bent. In other words, when the force causing the fiber to bend is released, the fiber should spring back to its original shape or very close to it. The manner in which the bending force is applied will effect the fiber's recovery. For example, a fiber will recover differently where a load is exerted only momentarily compared to a load maintained for a long duration.

The elastic properties of my fibers and their large diameter impart matting resistance thereto. Because of their large diameters they will be strained much more under normal matting conditions than conventional fibers. My experiments indicate that my fibers will be elongated or strained up to about 25% of their original length. However, my fibers can be fabricated so that in tension they will not permanently deform more than 10 percent, preferably no more than 5 percent, at elongations up to about 25% at strain rates in the range of from about 5 to about 50 $min^{-1}$. Conventional fibers will be elongated or strained up to about 10 percent in normal use. For my fiber to have a matting resistance equivalent to conventional fiber, its permanent deformation at 25 percent strain must be about equal to conventional fiber's permanent deformation at 10 percent strain. Table II sets forth data on ethylene-vinyl acetate (EVA) fibers which indicates this to be the case. Permanent deformation was determined by ASTM test method D1774-72 on monofilament fibers.

TABLE II

| Sample | % Permanent Deformation a 25% strain | a 10% strain |
|---|---|---|
| EVA[1](5% VA[2], 0% gel) | 6.55 | 2.10 |
| EVA[1](5% VA, 31% gel) | 4.40 | 0.55 |
| EVA[1](5% VA, 36% gel) | 3.80 | 0.30 |
| EVA[1](5% VA, 50% gel) | 1.50 | 0.35 |
| Polypropylene | 12.25 | 2.95 |
| Nylon | 14.60 | 1.95 |

[1]Ethylene-vinyl acetate
[2]Vinyl acetate

My first also resist matting because they tend to avoid becoming entangled with each other. This is due to their large diameters. The smaller the fiber diameter and the closer the fibers are packed together, the greater the frictional forces holding the fibers together or in a matted condition. Since the carpets using my fiber will generally have a fewer number of fibers per square inch of carpet backing than conventional carpets and these are larger diameter fibers, the frictional forces are substantially lower than conventional carpets; and therefore, they tend to resist matting.

Wear Resistance

To attain good wear, i.e., avoid loss of fiber from the carpet, the fiber must be able to withstand pulling and repeated rubbing. The material of my fiber is inherently weaker than the material used in conventional fibers. Consequently, one would suspect that my fiber would not be able to withstand wear. However, because my fiber is substantially thicker than conventional fiber, there is more material present. Because of this additional material my fiber wears as well as conventional fiber.

Specifically, carpets wear out mainly when fibers are lost because they are broken by being pulled or abraded. Many different types of forces tend to pull fibers from the backing. Thus in use, the fibers are subjected to stress. Stress ($\delta$) is the tensile force (F) acting on the fiber divided by the cross-sectional area (A) of the fiber:

$$\delta = F/A$$

Since the forces acting on conventional nylon fibers and my fibers will under most circumstances be equal, if the cross-sectional area of my fiber was equal to that of conventional fiber, it would break or not wear as well as nylon fiber. However, this is not the case. My fiber, since it has a substantially larger diameter than conventional fiber, has a much larger area. Thus, although the stress ($\delta$) that my fiber can withstand to its yield point or fracture is lower than that of nylon, the larger area (A) of my fiber, when multiplied by the stress (δ), yields an equivalent force (F) to deform or break the fiber.

Other Properties

A pile fabric designed for use as carpeting made from my fibers will have, for comparable carpet construction, substantially fewer fibers per square inch of backing than do conventional pile carpets made of nylon yarn. For good coverage, the minimum number of monofilament fibers will be 4,000 per square inch of backing and the minimum pile height will be one-eight of an inch. In contrast, the minimum number of monofilament fibers used in conventional nylon carpets is approximately 20,000 per square inch of backing.

Because there are a fewer number of fibers in a square inch of carpet backing for my pile fabric, this pile fabric will feel slightly cooler to the touch than nylon pile fabrics. The reason for this is that there are less dead air spaces, and consequently, the fabric is a poorer insulator than conventional carpets. Thus, when the hand touches this carpet, more heat from the hand flows into this carpet than conventional carpets. Hence the cooler touch.

The pile fabric of my invention also has a slightly smoother feel than conventional nylon pile fabrics. This is mainly due to the reduced number of fibers in a square inch of backing. Because fewer fibers are present, the coefficient of friction of the pile fabric of my invention is less than the coefficient of friction of conventional nylon pile fabrics.

The lower coefficient of friction and poorer insulating properties of my fabric actually provide an advantage, namely, reduction of carpet burns. Carpet burns are caused by rapidly rubbing one's skin against the pile. Carpets having a high coefficient of friction and good insulating properties are more likely to produce a carpet burn. The reason is that the higher coefficient of friction produces more heat which, due to the carpet's good insulating properties, is not conducted away from the skin.

In abrasive wear, rubbing action forces tiny dirt particles to cut through fibers. Nylon, being a hard material, is not readily cut by these particles. In contrast, the material I use in my fiber is substantially softer than nylon. Thus, in abrasive wear, dirt particles will cut through my fiber with less difficulty. Because more material is present, my fiber, however, will wear as well as nylon fiber which is relatively thin.

Tuftability

For the fiber to be tufted or otherwise be handled during processing, it must have a certain inelasticity and strength. If the fiber is too elastic it will act like a rubber band. Thus, instead of a tufting needle forcing fiber through the carpet backing, it will simply stretch the fiber. On release of the needle, the fiber will spring back into its original state and a tuft will not be formed. I have found that if the elastic modulus exceeds 5,000 psi, my fiber will be sufficiently inelastic for tufting. The fiber also should have enough strength so that it won't break during tufting or other carpet making processes. I have found that if my fiber has an ultimate tensile strength of at least 5,000 psi it will be suitable for most carpet making processes. Moreover, fiber lubricants can be used to reduce frictional forces leading to breakage.

DESCRIPTION OF THE DRAWINGS

FIG. 1 is a side elevational view of an extruder and draw-line used in spinning the fiber of my invention.

FIG. 1*a* is a front elevational view of the spinnerette plate.

FIG. 1*b* is an enlarged fragmentary view of the orifices in the spinnerette plate.

FIG. 2 is a conventional draw-winding apparatus for drawing or stretching the fiber at temperatures below 100° F.

FIG. 3 is a side elevational view of the apparatus used to heat the fiber under tension.

DETAILED DESCRIPTION OF THE INVENTION

Figure 4:
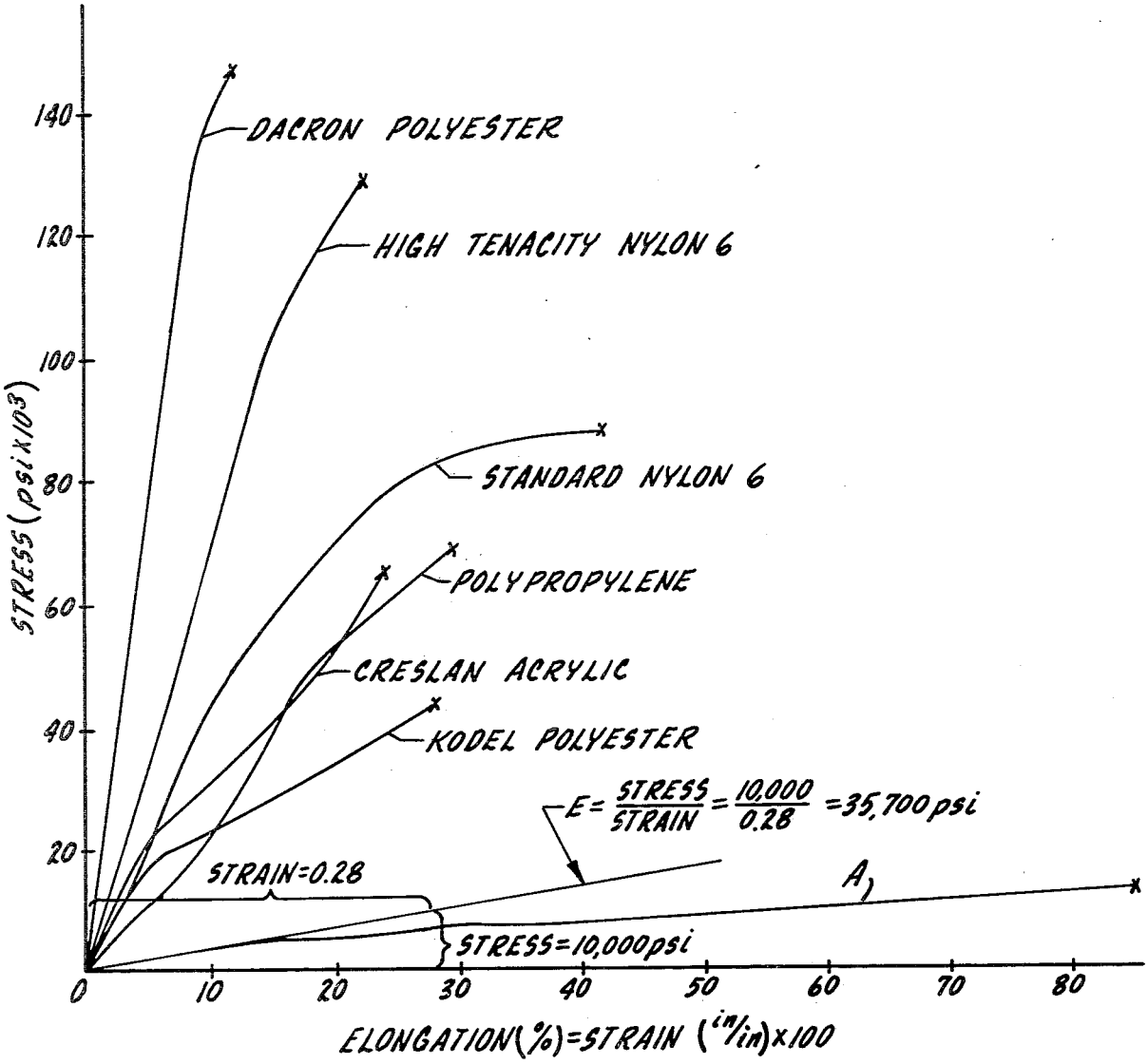
FIG. 4 is a graph showing the stress-strain curves for various conventional fibers as well as the fiber of my invention.

Referring first to FIG. 1, there is shown a preferred method of making the fibers of my invention. Polymeric material having the proper elastic modulus is extruded into a plurality of monofilaments using a conventional extruder 10 as is described in a paper presented by D. Poller and O. L. Riedy, "Effect of Monofilament Die Characteristics on Processability and Extrudate Quality", 20th Annual SPE Conference, 1964, paper XXII-2. Extruder 10 includes a hopper 12 into which pellets of polymeric material are deposited, an extruder barrel 14 where the pellets are melted, a static mixer 15, and a spinnerette plate 16 through which the molten polymeric material is forced.

The melted polymeric material leaves the spinneret plate 16 as a plurality of molten strands 18 of polymer which continously flow downwardly into a water bath 20 maintained at a temperature in the range of ambient to about 150° F. When the molten polymer strands strike the water in the bath 20, they are chilled rapidly and become a continuous solid monofilament fiber 21. This fiber passes around a pair of guides 22 and 24 and through a guide plate 26 into the nip of a pair of rollers 28 and 30. These rollers 28 and 30 pull on the fiber to draw the molten polymer strands 18 so that each strand has a diameter of about 6 to about 15 mils and preferably from about 7 to about 9 mils. On leaving the rollers 28 and 30, the solid monofilaments pass through a fiber guide/braking system 32 and are wrapped about spools 34 mounted on a winder 36.

FIG. 1*a* illustrates in detail spinnerette plate 16 which may include three rows 17*a*, 17*b*, and 17*c* of aligned orifices or holes. For extruding monofilaments to form the fibers of my invention, the orifices preferably have an area in the range of from $8\times10^{-5}$ to $70\times10^{-5}$ in$^2$. As shown in FIG. 1*b*, the holes making up the central row 17*b* are offset at an angle of about 60° with respect to the holes in top and bottom rows 17*a* and 17*c*. The spacings between the top row 17*a* and the center row 17*b* and the bottom row 17*c* and the center row 17*b* are each approximately 0.065 inch. The spacing between adjacent holes in any one row is approximately 0.075 inch. The holes may be straight or tapered at an angle of approximately 15° to 30°.

Turning now to FIG. 2, there is shown the drawing of monofilaments in the solid state. This solid state drawing is performed at a temperature below about 100° F. and reduces the diameter of the extruded monofilaments from about 6 to 15 mils to about 3 to 6 mils. A spool 34*a*, loaded with multiple strands of monofilament is removed from the winder 36 of FIG. 1 and placed on the draw winding apparatus 38 shown in FIG. 2. The lead ends of the fibers 21 on the spool 34*a* are unwound, guided about two drawing godets 40 and 42, and wrapped around a second spool 44. These godets 40 and 42 turn at different angular velocities so the fibers 21 coming off the spool 34*a* are stretched.

The drawn, solid monofilaments are then subsequently heated to a temperature above about 100° F. but below their melting point to heat set the fibers so as to increase their shrink resistance. As shown in FIG. 3, fibers 21 from spool 44 first pass through a pair of draw rolls 48 and 50 which pull the fiber over a pre-heater 52 and feed the fiber into the nip of an input feed roll assembly 54. The fibers pass through the heater 46 and over a feed roll 56 to the takeup spool 58. When the fibers comprise a copolymer of ethylene and vinyl acetate, the preferred heater temperature is in the range of about 150° to 200° F. The tension on fibers 21 as they pass through the heater 46 is sufficient to prevent them from shrinking. Fibers 21, however, are not stretched so their diameter remains unchanged through the heating step.

In a preferred embodiment, the bundle of fiber strands is twisted together to form a yarn prior to heat setting. In an optional embodiment, the fibers may be heat set at a later stage as during a yarn bulking step. For example, if yarn bulking were accomplished by use of the knit-denitting process, heat setting may be accomplished by heating the knitted sock under tension.

To improve the heat resistance of the fiber, it is preferred to partially cross-link the molecules of the polymeric material. This may be achieved by mixing a free radical former such as a peroxide, e.g. ditertiary butyl peroxide with the polymeric material and then adding a monomer having at least two vinyl groups as the cross-linking agent such as for example, divinyl benzene, trivinyl benzene, diallyl phthalate, triallyl cyanurate, etc. Cross-linking polyethylene or ethylene-vinyl acetate copolymers is well known and is illustrated by British Pat. No. 853,640, for example, which lists many peroxy activators and cross-linking monomers. Peroxides alone are known cross-linkers for the polyethylenes. A vinyl silane grafted on the polyethylene chain by a peroxide may serve as a cross-linking mechanism.

Most preferably, cross-linking is achieved by irradiating the fiber with an electron beam either as yarn or in carpet form. The dosage of radiation should be sufficient to cross-link the molecules to the extent that they have a gel content greater than 30% but less than 90%. The preferred gel content is 45–55%. Gel content of the ethylene-vinyl acetate fiber is determined according to the following procedure.

Fibers are wound around a metal wire screen and subjected to solvent elution in hot xylene near the boiling point for 24 hrs. Gel content is then calculated using the formula:

$$\% \text{ gel} = (W_f/W_o) \times 100$$

where $W_o$ is the initial weight of the sample and $W_f$ is the final weight after elution.

In accordance with my invention, the polymeric material may be partially cross-linked prior to heat setting the drawn solid monofilament. This permits the fiber to be heat set at higher temperatures, and therefore, further increases its shrink resistance. Preferably, in the first cross-linking step the polymeric material is cross-linked to the extent that the gel content is no greater than about 15%, and in the second cross-linking step the polymeric material is partially cross-linked to the extent that the gel content is no greater than 90%.

To enhance radiation cross-linking, there is distributed through-out the polymeric material fine particles of silicon dioxide or titanium dioxide. The particle size of these oxides range between 100 angstroms and 1 micron and the amount used is below 1 volume percent. This small amount of oxide improves the efficiency of the irradiation step. For example, a polymeric material irradiated at a dosage of 10 megarads (MR) will have a gel content of 25–28%. When this same polymer includes 0.2 volume % silicon dioxide and is irradiated at the same dosage, the gel content is 40–45%. This increase in gel content represents a substantial increase in the melting point of the polymeric material. Also the addition of poly-functional monomers improves cross-linking. For example, triallyl cyanurate or allyl acylate, alone or in combination with the oxides, are additives which enhance the cross-linking yield for a given radiation dosage.

In general, due to their larger diameter, my fibers can be loaded with fillers to higher levels than can conventional carpet fibers. Specifically, pigments may be used to color my fiber. Such pigments may be dispersed throughout the molten polymeric material prior to extrusion. These pigments will normally have a particle size in the range of from about 1 to about 25 microns. The amount of pigment normally ranges between about ½ and about 20% of the total weight of the blend.

Exemplary of the pigments which may be employed are organic colorants such as phthalocyanine green and inorganic colorants such as cadmium yellow. Any commonly available colorant which is compatable with the polymers compositions may be used. Fillers which may be used include, for example, silicia aerogels, calcium silicate, aluminum silicate, carbon black and alumina in a weight percent as high as 20% or more. Obviously, some of the additives may have more than one function. For example, some of the mineral fillers may also serve as pigments and vice versa, e.g. carbon black and titanium dioxides.

In one embodiment of my invention, pellets of color concentrate are initially prepared. These color concentrate pellets are blended in the extruder with non-colored pellets. The colored and non-colored pellets then melt and mix together thoroughly during the extrusion. It is also possible to color my fiber with a dispersed dye, but under some conditions this type of dye tends to bleed out of the fiber. Cross-linking subsequent to dyeing tends to fix these dyes.

In addition to coloring agents and fillers, it is possible to include in the fiber well known and available flame retardants, antistatic agents, or antisoiling agents. Antioxidants and stabilizers may likewise be added, such as for example, unsaturated benzophenone derivatives described in U.S. Pat. No. 3,214,492, N-N' dinaphthyl p-phenylene diamine, or Irganox 1010, a multi-functional antioxidant having four sterically hindered phenolic groups, available from Ciba-Geigy. Because of the low melting point of the polymers used in the manufacture of my fiber, I can also use additives, especially dyes, flame retardants, antistatic agents and antisoiling agents which are sensitive to, or degrade at, temperatures necessary to process nylon into fiber.

Extrusion temperatures used with certain of my fiber-forming polymers, especially with ethylene-vinyl acetate, do not exceed 500° F. This relatively low extrusion temperature allows me to use hydrated magnesia as a flame or fire retardant. Hydrated magnesia will release its contained water rapidly at temperatures above about 500° F.; a property which precludes its use with nylon and similar polymers. As is well known in the art, hydrated magnesia is a low cost, highly effective fire retardant but, prior to this time, one which could not be used in thermoplastic fibers.

Because of the relatively large diameter of my fiber, the extrusion and cooling equipment used in its manufacture are inexpensive. This savings in equipment cost plus the use of low cost polymer result in a fiber which is inexpensive relative to nylon. This is one very important advantage of my fiber.

FIG. 4 contrasts the stress-strain curves of a typical fiber of my invention with that of conventional carpet fibers. Stress and strain or elongation were measured according to ASTM standard method No. D2256-69. The Curve A represents the fiber of my invention. In contrast to my fiber, the conventional fibers have higher ultimate tensile strengths and will elongate substantially less at higher stress levels. The toughness or wearability of the fibers correlates to the area under the stress-strain curves. Note the area under Curve A is about the same as the area under the stress-strain curves of the conventional fibers. The fiber of the stress-strain Curve A was made from ethylene-5% vinyl acetate copolymer having a melt index of 2.0.

The fibers of my invention may be used in conventional manner to make pile fabrics. Pile fabrics, useful as carpeting for example, are conventionally manufactured either by weaving wherein a face or pile yarn is woven into a backing, or by tufting wherein the pile yarn is needle-tufted through a backing at spaced points to form upstanding loops or tufts projecting from the face of the backing. Tufted fabrics also require means such as an adhesive coating over the underside of the backing to hold the pile from being pulled out.

Figure 5:
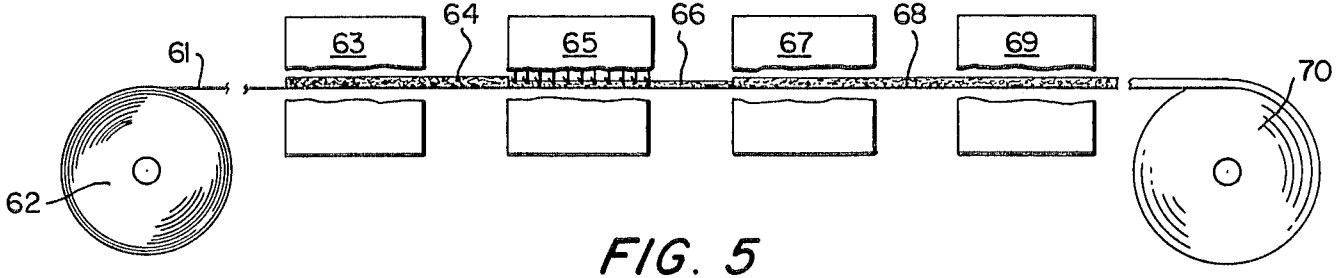
FIG. 5 is a schematic representation of a method for making pile fabrics from the fibers of my invention.

FIG. 5 illustrates one preferred method of manufacturing carpeting according to my invention. As the apparatus used in this method of carpet manufacture are all well known to the art, they have been shown only in block form and will not be described in detail.

The carpeting is built on a scrim 61 fed from a supply roll 62. The scrim may comprise any of the conventional woven or non-woven types including jute, burlap, woven and non-woven polymeric fiber webs and the like. A conventional lapper 63 then is used to deposit a uniform web or batt of garnetted staple fibers 64 on the upper or face surface of scrim 61. Fibers 64 may comprise the fibers of this invention in staple length of about 1 to about 4 inches or may comprise staple fibers of other compositions including nylon, polypropylene and the like. Mixtures of staple fibers including the fibers of this invention may also be used.

The scrim carrying a fiber batt is then passed through a needle loom 65, such as the standard Dilo loom, which needle bonds the fiber layer to the scrim to form a carpet subface 66. Thickness and density of subface 66 may be varied as desired by controlling the amount of thickness of staple fibers deposited by lapper 63 and by varying the needle density of loom 65.

After needlebonding, subface 66 is passed through a conventional tufter 67 which tufts yarn though the subface layer 66 to produce a fabric 68 having tufts extending above the subface layer 66 to form a pile. The yarn used in tufter 67 comprises the fiber of my invention twisted together and bulked to form a product suitable for use in conventional tufters. Approximately 15 to 50 fibers make up each yarn strand. Preferably, the yarn has from 0.5 to 2.0 twists per linear inch and has a denier ranging between 1,500 and 4,000. In some instances, my fiber may be blended with conventional fibers, such as monofilament nylon fiber to form a composite yarn.

In other embodiments of my invention, yarn may be tufted directly through a scrim layer to form a fabric lacking the needlebonded layer of staple fibers. This embodiment generally requires use of a heavier scrim but also dispenses with lapper 63 and needle loom 65. It is also possible, and in some instances desirable, to produce scrimless pile fabrics. In this embodiment, lapper 63 deposits staple fibers on a floating bed which carries the bulk through needle loom 65 to form a non-woven, needle bonded carpet base.

After tufting, the formed pile fabric is passed through suitable finishing means 69. Means 69 may comprise any of the standard fabric finishing steps such as printing, which involves the application of dyes in localized areas to form any desired pattern, or it may comprise shearing or other means of surface texturing the fabric.

Means 69 may also include suitable units for backfinishing the fabric, especially those fabrics designed for use as carpeting. Backfinishing may include backsizing with an adhesive such as latex, which functions to lock each tuft or yarn into the carpet base, or may include the bonding of a secondary backing layer to the carpet. Backing layers suitable for use with this invention include those conventionally applied to carpeting including woven jute, rubber latex foam, polyurethane foam and the like. The secondary backing layer may be applied to the carpeting fabric by means of a suitable adhesive as, for example, a latex adhesive. After backfinishing, the fabric is wound onto a roll 70 for storage and transport.

Figure 6:
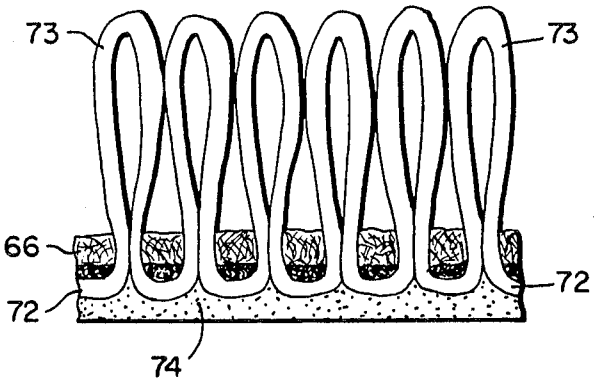
FIG. 6 is a fragmentary view in cross-section illustrating a piece of fabric formed according to the invention.

FIG. 6 illustrates a fragmentary cross-sectional view of a pile carpet made by the process of my invention. A subface layer 66 has tufted through it yarn 72 to develop a fabric face comprising yarn tufts 73 which extend at least $\frac{1}{8}$ inch, and preferably more, above the subface layer. The tufts 73 may be of the loop type as is shown or may be cut or sheared. Spacing of the tufts may be uniform as is shown or may be varied in any desired pattern. Backfinishing layer or secondary backing layer 74 provides a finished back surface to the fabric and locks the individual pile tufts 73 into place.

The following examples serve to more completely illustrate specific embodiments of my invention.

EXAMPLE 1

An ethylene-vinyl acetate copolymer was extruded into monofilaments as described in the discussion of FIG. 1. Polymer pellets were commercially obtained from U.S. Industries, Inc., under the designation NA294, a 5% vinyl acetate, ethylene-vinyl acetate copolymer, having a melt index of 2.0 and a melting point of 240° F. The copolymer was extruded as received without coloring agents or additives on a $\frac{3}{4}$ inch single screw extruder through a 40 hole spinnerette and the filament bundle was later formed into bulked, continuous filament yarn containing 40 filaments.

The spinneret plate had 0.013" diameter holes with a 30° taper. The extruded fibers were drawn in the liquid phase to a diameter of 0.0073 inch and solidified in a parallel row on a chill roll. The temperature profile in the extruder increased from 340° F. at the hopper zone to 480° F. at the exit zone. Extruder screw speed was 15 rpm and the screw was driven at 6.0 amps. Line speed on the take up was 28 feet per minute.

The yarn was treated with a silicone finish and was then drawn and textured on a Pinlon machine. The draw ratio was 3:1, with the final filament diameter being 0.0041–0.0043 inch (69–76 denier). The yarn was then cross-linked on a 3 MeV electron beam machine at a dosage of 10 Mrad. (Gel content by elution in xylene=28%). The mechanical properties of this fiber were as follows: diameter of 0.0041 in. (69 denier), 10% offset yield stress of 8780 psi (0.74 gpd), ultimate tensile strength of 13,200 psi (1.13 gpd), elastic modulus of 35,700 psi, and elongation to fracture of 85%.

EXAMPLE 2

The ethylene-vinyl acetate copolymer used in Example 1 was mixed with a prepared color concentrate in a copolymer to concentrate ratio of 10:1. The color concentrate pellets contained 5 weight percent of light green pigment (Harwick).

The copolymer-concentrate mixture was extruded into monofilaments using a commercial monofilament production line in which extrusion and drawing were done in-line. Twelve yarn ends, each with 20 continuous filaments were spun from a single spinnerette.

A 1.5 inch, single screw extruder having a Fluid Dynamics® filter (×13) installed between the gear pump and spinneret was operated at an extruder screw speed of 100 rpm and a gear pump speed of 30 rpm to produce a polymer throughput of 31 lb/hr. A pressure transducer, mounted before the filter, recorded a pressure of 1600–1800 psi throughout the run. The temperature profile in the extruder was as follows: Zone 1=380° F., Zone 2=440° F., Exit=440° F., Spinnerette=440° F.

The yarn bundles were quenched in a water bath containing a surface finish agent in emulsion form and were drawn in a parallel array in a single stage between godet rolls to a 3.3:1 ratio. The feed rolls rotated at 23.7 m/min, and the take up rolls rotated at 78.3 m/min. Final yarn denier was 2650 (approximately 132 den/fil).

The yarn (not individual fibers) was tested for mechanical properties. It had a tensile strength of 0.87 g/den (10,200 psi), an elastic modulus of 3.4 g/den (27,200 psi), and an elongation to fracture of 113%. This yarn was bulked by twisting at 0.75 turns per inch, then knit on a commercial machine into a long tube. This tube was subjected to electron beam irradiation to a dosage of 10 Mrad and deknit. The deknit yarn had a substantial crimp and was subsequently tufted into carpet. The gel content measured on the yarn was 28%.

EXAMPLE 3

A series of tests were performed to determine the effect of various additives on the electron beam irradiation of my fibers. Fibers were manufactured using the same ethylene-vinyl acetate copolymer and extrusion technique as was described Example 1 except that the additives listed in Table IV were mixed with the polymer pellets during extrusion.

TABLE III

| Additive (wt. %) | Electron Beam Dosage (Mrad) | Gel Content % |
|---|---|---|
| None | 10 | 28 |
| $SiO_2$(0.48) | 10 | 44.1 |
| $TiO_2$(1.8) | 10 | 48.7 |
| TAC* (1.0) | 10 | 45.5 |

*Triallyl cyanurate

After extrusion and drawing at a 3:1 ratio, all fiber samples were subjected to the same dosage of cross-linking electron beam irradiation and were subsequently analyzed for gel content which is a measure of the cross-linking attained. Gel content was determined by extraction in hot xylene in the manner previously described.

As is clear from the data presented in the Table, minor amounts of silicon dioxide, titanium dioxide or triallylcyanurate incorporated into the fiber substantially increase the efficiency of the electron beam irradiation. Higher gel levels, or higher levels of cross-linking, improve certain properties of the fibers including resilience and shrinkage resistance. The mechanical properties of the fibers were not substantially different from those of Example 1.

EXAMPLE 4

An ethylene-vinyl acetate copolymer having a 9% vinyl acetate content and a melt index of 3.0 was extruded into monofilaments and formed into yarn. Pigment was incorporated into the filaments during the extrusion step at a concentration of 0.5%.

Extrusion was performed using a one-inch, single screw extruder equipped with a screen pack (mesh sizes of 40-60-60-40) and a 40 hole spinnerette having a hole diameter of 0.015 inch. The temperature profile in the extruder increased from the hopper zone to the exit zone from 340° to 500° F. at the die. The screw speed on the extruder was 20 rpm and the screw was driven at 7.0 amps. The line speed on the take up was 38 fpm. Under these conditions, the fiber diameter was 0.009 inch.

The yarn was treated with a silicone finish and was then drawn and textured on a Pinlon machine. The draw ratio was set at 4:1, with the final filament diameter being 0.005 inch (100 denier). The yarn was cross-linked on a 3 MeV electron beam machine at a dosage of 10 Mrad. The mechanical properties of the new fibers were as follows: Diameter=0.005 in. (100 denier), 10% offset yield stress=7710 psi, ultimate tensile strength=10,300 psi, elastic modulus=39,300 psi, elongation to fracture=79.4%.

EXAMPLE 5

Ethylene-vinyl acetate fibers made according to my invention were cross-linked by radiation at a dosage level of 20 Mrad. The fibers were twisted together and bulked to form a carpet yarn. This yarn was then used to manufacture a pile carpet in the manner described in relation to FIG. 5. The finished carpet was examined and was considered to have a good hand with a slightly smoother feel than that of a comparable nylon carpet.

This manufactured carpet and a commercial nylon carpet of comparable weight were each subjected to a tetrapod walker test which is a standard dynamic test technique for evaluating carpets. Results of the tests are as follows:

TABLE IV

| SAMPLE | Cycles/o | Total Pile Height (mils) 6,345 | 20,130 | 85,530 | 164,000 | 444,820 | 687,620 |
|---|---|---|---|---|---|---|---|
| EVA* | 466 | 468 | 460 | 440 | 431 | 396 | 406 |
| Nylon | 450 | 439 | 441 | 444 | 447 | 437 | 404 |

*Ethylene-vinyl acetate

An examination of the test data shows that carpets manufactured of my fiber show essentially the same performance as that of nylon under these dynamic conditions. The same two carpets were also subjected to static loading conditions. Carpet using my fiber did not perform as well as nylon fiber under static loads but its performance was considered to be satisfactory.

I claim:

1. A monofilament fiber of polymeric material characterized by:

(a) an elastic modulus of from 5,000 to 60,000 psi, (b) an area moment of inertia of from $400\times10^{-14}$ to $7{,}000\times10^{-14}$ in$^4$, and (c) a stiffness parameter of from $1\times10^{-5}$ to $1\times10^{-8}$ lb-in$^2$.

2. The fiber of claim 1 where the polymeric material is a thermoplastic.

3. The fiber of claim 2 where the thermoplastic is (a) plasticized polyvinyl chloride, (b) low density polyethylene, (c) thermoplastic rubber, (d) ethylene-ethyl acrylate copolymer, (e) ethylene-butylene copolymer, (f) polybutylene and copolymers thereof, (g) ethylene-propylene copolymers, (h) chlorinated polypropylene, (i) chlorinated polybutylene, or (j) mixtures of these thermoplastics.

4. The fiber of claim 3 having dispersed therein one or more additives of the group consisting of colorants, fillers, flame retardants, antistatic agents and antisoiling agents.

5. The fiber of claim 4 wherein said thermoplastic is partially cross-linked.

6. The fiber of claim 5 wherein said fibers are partially cross-linked by irradiation and wherein at least one of said additives acts to enhance the radiation cross-linking thereof.

7. The fiber of claim 6 wherein said cross-linking enhancing additive is selected from the group consisting of silicon oxide, titanium dioxide and triallyl cyanurate.

8. The fiber of claim 4 wherein the weight percentage of additives in the fiber ranges from 0.5 to 20 percent.

9. The fiber of claim 8 wherein said colorant additive is a pigment having a particle size ranging from about 1 to about 25 microns.

10. The fiber of claim 8 wherein said flame retardant additive is hydrated magnesia.

11. The fiber of claim 3 having a generally circular cross-section with a diameter ranging from 3 to 6 mils.

12. The fiber of claim 3 further characterized in not permanently deforming in tension more than 10 percent at elongations up to 25 percent at strain rates in the range of 5 to 50 min$^{-1}$, said fiber also having an ultimate tensile strength of greater than 5,000 psi.

13. The fiber of claim 1 wherein said polymeric material comprises an ethylene-vinyl acetate copolymer having a vinyl acetate content of 1 to 10 percent and a melt index in the range of 0.5 to 9.

14. The fiber of claim 13 wherein said ethylene-vinyl acetate copolymer is partially cross-linked.

15. The fiber of claim 14 wherein cross-linking is accomplished by incorporating into the polymer a peroxy activator and a cross-linking agent.

16. The fiber of claim 14 wherein cross-linking is accomplished by irradiation.

17. The fiber of claim 16 wherein an additive selected from the group consisting of silicon dioxide, titanium dioxide, triallyl cyanurate and mixtures thereof is dispersed therein, said additive acting to enhance the radiation cross-linking of said copolymer.

18. The fiber of claim 17 cross-linked to the extent of having a gel content greater than 30% but less than 90%.

19. The fiber of claim 14 having dispersed therein one or more additives of the group consisting of colorants, fillers, flame retardants, antistatic agents and antisoiling agents.

20. The fiber of claim 19 wherein the weight percentage of additives in the fiber ranges from 0.5 to 20 percent.

21. The fiber of claim 20 including a flame retardant additive comprising hydrated magnesia.

22. The fiber of claim 20 including a colorant additive comprising a pigment having a particle size ranging from about 1 to about 25 microns.

23. The fiber of claim 20 having a generally circular cross-section with a diameter ranging from 3 to 6 mils.

24. The fiber of claim 20 further characterized in not permanently deforming in tension more than 10 percent at elongations up to 25 percent at strain rates in the range of 5 to 50 min$^{-1}$, said fiber also having an ultimate tensile strength in excess of 5,000 psi.

25. Yarn comprising a continuous strand of multiple monofilament fibers of polymeric material, said polymeric material characterized by:

(a) an elastic modulus of from 5,000 to 60,000 psi, (b) an area moment of inertia of from $400\times10^{-14}$ to $7{,}000\times10^{-14}$ in $^4$, and (c) a stiffness parameter of from $1\times10^{-5}$ to $1\times10^{-8}$ lb-in$^2$.

26. The yarn of claim 25 containing 15 to 50 fibers, said fibers twisted together and bulked to form a carpet yarn.

27. The yarn of claim 26 having from 0.5 to 2.0 twists per linear inch.

28. The yarn of claim 26 having a denier ranging from 1,500 to 4,000.

29. The yarn of claim 26 wherein each fiber has a generally circular cross-section with a diameter ranging from 3 to 6 mils.

30. The yarn of claim 26 wherein said fibers are pigmented.

31. The yarn of claim 26 wherein said fibers have a melting point above 200° F.

32. The yarn of claim 26 wherein said fibers comprise a partially cross-linked, ethylene-vinyl acetate copolymer having a vinyl acetate content of 1 to 10 percent and a melt index in the range of 0.5 to 9.0.

33. The yarn of claim 26 wherein said yarn is bulked by knitting and thereafter deknitting.

34. A pile fabric comprising a backing and yarns secured to the backing and extending outwardly therefrom, the yarns comprising a strand of multiple monofilament fibers of polymeric material, said polymeric material characterized by an elastic modulus of from 5,000 to 60,000 psi, an area moment of inertia of from $400\times10^{-14}$ to $7{,}000\times10^{-14}$ in$^4$, and a stiffness parameter of from $1\times10^{-5}$ to $1\times10^{-8}$ lb-in$^2$.

35. The fabric of claim 34 when said yarn forms a pile which has a minimum height of ⅛ inch and a minimum density of 4,000 monofilaments per square inch of backing.

36. The pile fabric of claim 34 where the monofilaments have an ultimate tensile strength of from about 5,000 to about 50,000 psi.

37. The pile fabric of claim 34 where the molecules of the polymeric material are partially cross-linked.

38. The fabric of claim 34 where said polymeric material contains additives which enhance the radiation cross-linking thereof.

39. The fabric of claim 34 where the polymeric material has dispersed therein one or more additives of the group consisting of colorants, fillers, flame retardants, antistatic agents and antisoiling agents.

40. The fabric of claim 39 where the weight percentage of additives in the yarn based on total yarn weight ranges from 0.5 to 20 percent.

41. The fabric of claim 39 where the polymeric material contains hydrated magnesia therein.

42. The fabric of claim 34 where each filament has a generally circular cross-section whose diameter is from 3 to 6 mils and does not permanently deform in tension more than 10 percent at elongations up to 25 percent at strain rates in the range of from 5 to 50 min$^{-1}$, and has an ultimate tensile strength of from about 5,000 to about 50,000 psi.

43. The fabric of claim 34 where the monofilaments are irradiated.

44. The fabric of claim 34 where said polymeric material comprises an ethylene-vinyl acetate copolymer having a vinyl acetate content of from 1 to 10 percent by weight and a melt index of from 0.5 to 9.

45. The fabric of claim 44 where the monofilaments have an ultimate tensile strength of from about 5,000 to about 50,000 psi.

46. The fabric of claim 44 where the copolymer has dispersed therein one or more additives of the group consisting of colorants, fillers, flame retardants, antistatic agents and antisoiling agents.

47. The fabric of claim 44 where the molecules of the ethylene-vinyl acetate polymer are partially cross-linked.

48. The fabric of claim 44 where said ethylene-vinyl acetate copolymer contains an additive which enhances radiation cross-linking.

49. The fabric of claim 48 wherein the additive consists of less than 1% by volume of fine particles of silicon dioxide ranging in size from about 100 angstroms to about 1 micron.

50. The fabric of claim 48 wherein the additive consists of fine particles of titanium dioxide ranging in size from about 100 angstroms to about 1 micron.

51. The fabric of claim 44 where the monofilaments are colored by pigments having a particle size of from about 1 to about 26 microns dispersed throughout the copolymer material.

52. The fabric of claim 51 where the weight percentage of pigments based on total yarn weight ranges from about 0.5 to about 20 percent.

53. The fabric of claim 44 where the copolymer material contains hydrated magnesia.

54. The fabric of claim 44 where each filament has a generally circular cross-section whose diameter is from 3 to 6 mils.

55. The fabric of claim 54 where each filament does not permanently deform in tension more than 10 percent at elongations up to 25 percent at strain rates in the range of from 5 to 50 min$^{-1}$ and has an ultimate tensile strength of from about 5,000 to about 50,000 psi.

56. The pile fabric of claim 34 wherein said backing comprises a scrim having needled thereto a web of staple fibers.

57. The fabric of claim 56 wherein said staple fibers comprise the fiber of claim 1.

58. The fabric of claim 34 wherein said pile is formed by yarn tufts extending at least ⅛ inch from the backing and forming a fabric face.

59. The fabric of claim 58 wherein said tufts are yarn loops.

60. The fabric of claim 59 wherein the spacing of the yarn loops on the backing is uniform.

61. The fabric of claim 34 including a secondary backing layer secured to said fabric.

62. The fabric of claim 58 including a backsizing coating, said coating serving to lock each yarn tuft into the fabric backing.

63. The fabric of claim 62 wherein said backsizing coating comprises a latex adhesive.

* * * * *